US007552677B2

(12) United States Patent
McLean et al.

(10) Patent No.: US 7,552,677 B2
(45) Date of Patent: Jun. 30, 2009

(54) SYSTEM AND METHOD FOR TEXTURING A SURFACE

(75) Inventors: Mark A. McLean, Wausau, WI (US); Kevin Schmidt, Schofield, WI (US); Marcia Werner, Edgar, WI (US); Jason Wolf, Wausau, WI (US); Robert W. Cornell, Schofield, WI (US); Tiffany Broecker, Stevens Point, WI (US)

(73) Assignee: Fiskars Brands, Inc., Madison, WI (US)

( * ) Notice: Subject to any disclaimer, the term of this patent is extended or adjusted under 35 U.S.C. 154(b) by 0 days.

(21) Appl. No.: 11/904,676

(22) Filed: Sep. 28, 2007

(65) Prior Publication Data

US 2008/0028954 A1 Feb. 7, 2008

Related U.S. Application Data

(62) Division of application No. 11/047,907, filed on Feb. 1, 2005, now Pat. No. 7,296,513.

(60) Provisional application No. 60/541,421, filed on Feb. 3, 2004.

(51) Int. Cl.
*B44C 1/24* (2006.01)

(52) U.S. Cl. ..... 101/32; 101/3.1; 101/406

(58) Field of Classification Search ..... None
See application file for complete search history.

(56) References Cited

U.S. PATENT DOCUMENTS

| | | | | |
|---|---|---|---|---|
| 806,111 | A | | 12/1905 | De Coppet |
| 1,934,277 | A | * | 11/1933 | Rankin ..... 101/3.1 |
| 3,063,364 | A | | 11/1962 | Kahlen |
| 5,042,382 | A | | 8/1991 | Yanazaki et al. |
| 5,419,247 | A | | 5/1995 | Bachmann |
| 5,495,800 | A | * | 3/1996 | Weissbein et al. ..... 101/329 |
| 5,511,472 | A | | 4/1996 | Taylor |
| 5,778,774 | A | * | 7/1998 | Lavoie ..... 101/28 |
| 6,446,549 | B1 | | 9/2002 | Soucie et al. |
| 6,520,081 | B2 | | 2/2003 | Oh |

FOREIGN PATENT DOCUMENTS

DE 24 44 505 A1 4/1976

* cited by examiner

*Primary Examiner*—Jill E. Culler
(74) *Attorney, Agent, or Firm*—Foley & Lardner LLP

(57) ABSTRACT

A texture tool comprising a body to which is coupled an upper cap and a lower cap. A ball holder fits in a socket defined by the body and the lower cap. The ball holder includes a plurality of balls which come into contact with a sheet of material to be embossed or imprinted.

8 Claims, 4 Drawing Sheets

SYSTEM AND METHOD FOR TEXTURING A SURFACE

CROSS-REFERENCE TO RELATED PATENT APPLICATIONS

The present application is a divisional application of U.S. patent application Ser. No. 11/047,907, filed Feb. 1, 2005, which claims priority to U.S. Provisional Patent Application No. 60/541,421, field on Feb. 3, 2004 and incorporated by reference in its entirety.

FIELD OF THE INVENTION

The present invention relates generally to a tool for use in arts and crafts. More particularly, the present invention relates to a tool for use in creating a textured surface on a sheet of material.

BACKGROUND OF THE INVENTION

In the arts and crafts field, it is often necessary and/or desirable to add a specific texture to a piece of material, be it cardstock, paper, vellum or other materials. One conventional system for adding a texture to a material involves placing a "texture plate" under the sheet of material to be manipulated, after which the user uses a stylus or similar hard object to press the material against the texture plate. This action causes the material to obtain a texture substantially identical to the texture that exists on the texture plate.

Although moderately useful, the above prior art method and others for adding a texture to a sheet of material have several significant drawbacks. First, using a stylus or similar implement can be difficult to control, resulting in the user inadvertently adding texture to portions of the material that he or she did not intend. Second, if the user presses too hard with the stylus against the sheet of material, the material could be torn, scratched or otherwise defaced in an undesirable manner. Additionally, a stylus or similar implement often results in an uneven texture being applied to the material, due to different pressures being applied in different locations. Furthermore, if the texture-inducing implement does not fall squarely into an individual crevice or dimple, the embossed texture will not be of an extremely high quality, resulting in an inferior overall appearance to the embossment.

SUMMARY OF THE INVENTION

It is therefore an object of the present invention to provide an improved texture-creating device that provides for a uniform and consistent embossment of the texture on a sheet of material.

It is another object of the present invention to provide an improved texture-creating device that is simple to use.

It is yet another object of the present invention to provide an improved texture-creating tool that reduces the risk of inadvertently tearing or damaging the material to be manipulated.

It is still another object of the present invention to provide an improved texture-creating tool that gives the user an increased level of accuracy in the portions of the material that are to be manipulated.

In accordance with the above objects, a texture tool according to the present invention comprises a body coupled to an upper cap and a lower cap. A ball holder rests in a socket defined by the inside of the body and the lower cap. The ball holder includes a plurality of balls that are mounted within depressions on the ball holder along a flat surface. When a user desires to add a texture to a material, the user simply moves the texture tool along the material such that the plurality of the balls rub against the material in the desired location, creating a consistent and uniform texture in the desired area.

Further advantages and features of the present invention will be apparent from the following specification and drawings illustrating the preferred embodiments of the present invention.

DETAILED DESCRIPTION OF THE PREFERRED EMBODIMENTS

Figure 1:
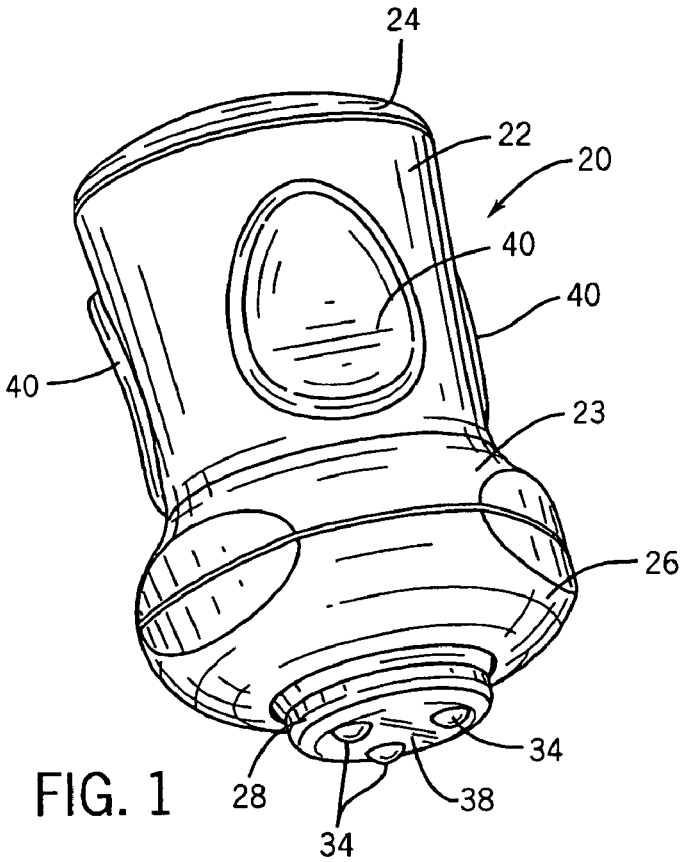
FIG. 1 is a perspective view of the texture tool constructed according to the principals of the present invention.
Figure 2:
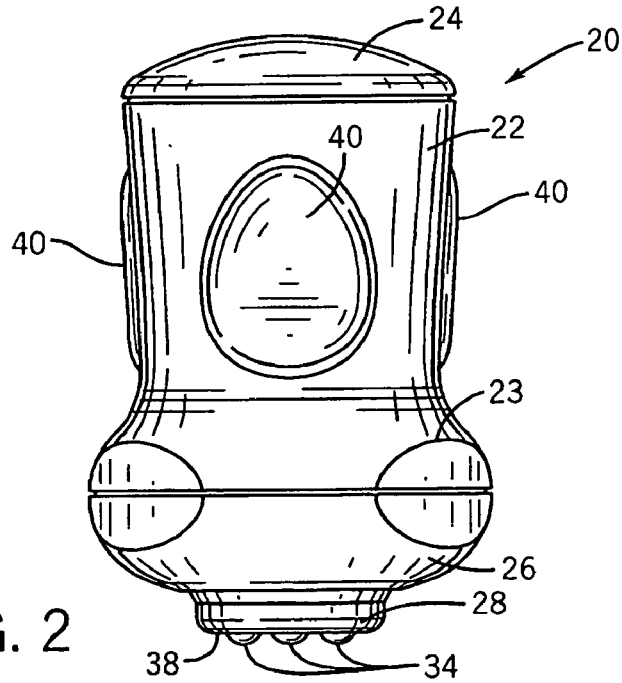
FIG. 2 is a right side view of the texture tool of FIG. 1.

A texture tool constructed according to the principals of the present invention is shown generally at 20 in FIGS. 1-7. The texture tool 20 comprises a body 22 to which is coupled an upper cap 24 and a lower cap 26. The lower portion 23 of the body 22 and the lower cap 26 combine to form a socket 30 on the inside thereof, as is shown more clearly in FIG. 6. A ball holder 28 partially fits within the socket 30. The ball holder 28 includes a plurality of balls 34 that are mounted within a plurality of depressions 36 (see FIG. 6) on a flat surface 38 of the ball holder 28. In a preferred embodiment of the invention, there are three balls 34 that are securely mounted within the depressions 36 of the ball holder 28, for reasons more specifically explained herein. In one embodiment of the invention, the body 22 also includes a plurality of grip portions 40 by which a user can securely hold onto the texture tool 20.

The ball holder 28 is free to rotate within the socket 30, essentially creating a ball-and-socket joint and allowing the individual balls 34 to catch edges and/or texture plate depressions 44 and remain in the texture plate depressions 44, improving the quality of the overall embossment. The ball holder 26 is substantially spherical except for the flat surface 38. The ball holder 28 has enough clearance to permit it to rotate, allowing a neutral hand position and allowing the individual balls 34 to fall into the texture plate depressions 44 and spin with the ball holder 28 about a substantially vertical axis.

Figure 8:
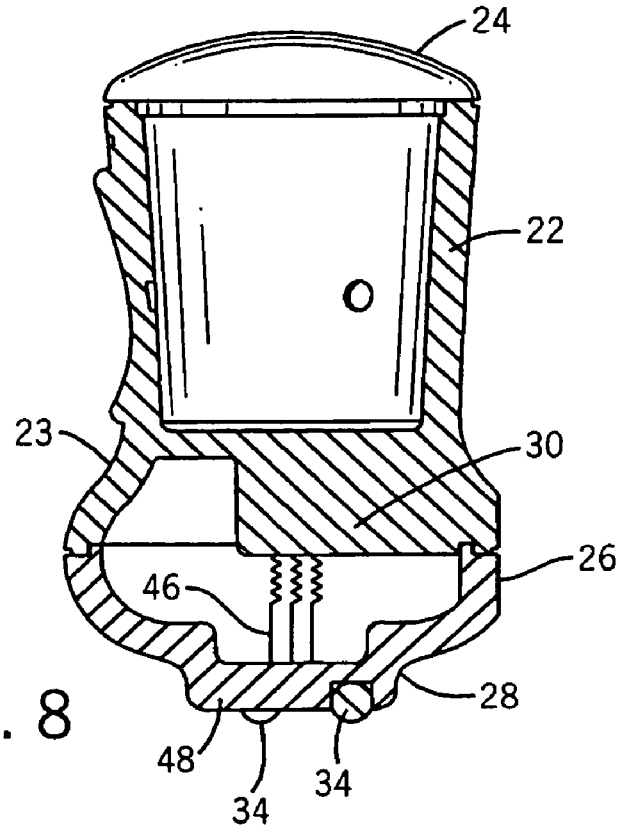
FIG. 8 is a sectional side view of a texture tool constructed according to a second embodiment of the invention.
Figure 9:
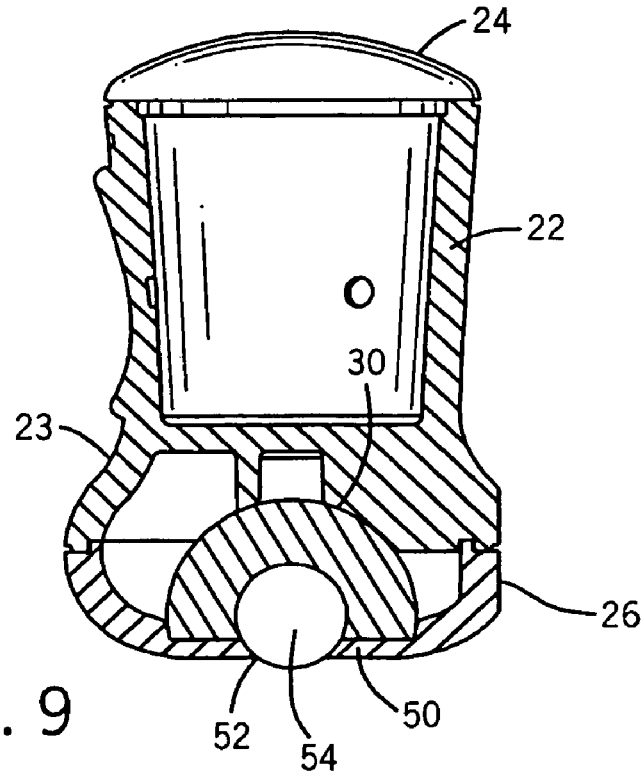
FIG. 9 is a sectional side view of a texture tool constructed according to a third embodiment of the invention.

Alternatively and as shown in FIG. 8, a plurality of independent spring-loaded pins 46 could be located within the texture tool 20 and press against a flat, rotating surface 48 to accomplish the same effect. It is also possible to use other arrangements, such as a flat washer 50 with a dimple 52 in the center for accepting a stylus ball 54, as shown in FIG. 9, to create a spinning and rotating flat surface. All of these arrangements and others have the effect of creating a plane that is free to float and spin in order to remain in contact with another surface even when the orientation of the rest of the tool is altered.

Figure 7:
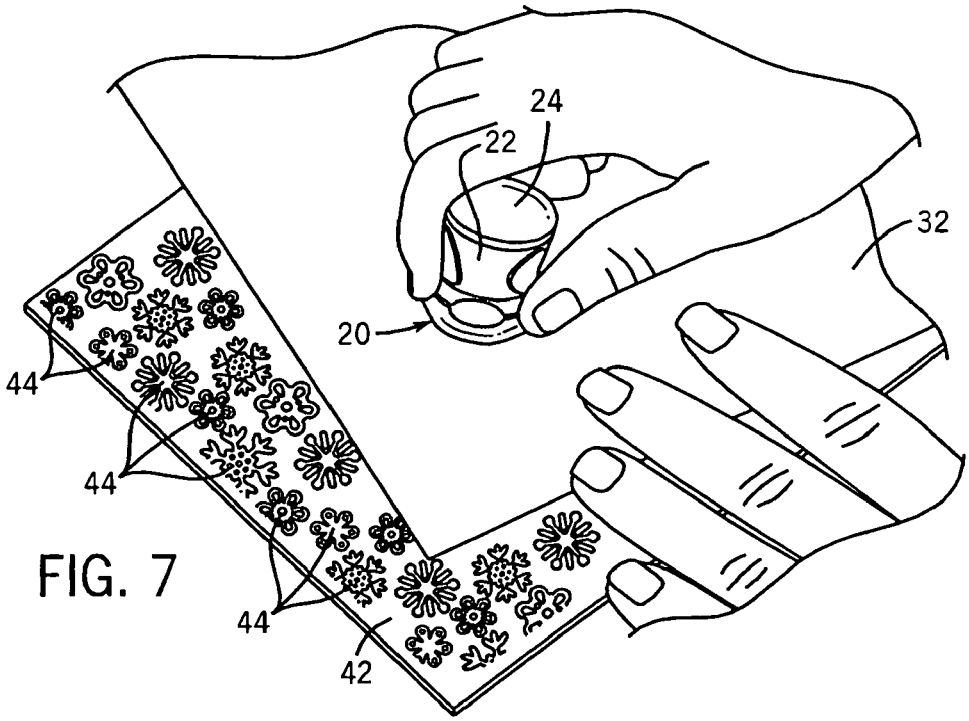
FIG. 7 is a perspective view of the texture tool while in use.

As is shown in FIG. 7, the texture tool 20 is used to create a texture on a sheet of material 32 that is placed on top of a texture plate 42. To create the texture, the user simply positions the texture tool 20 with the flat surface 38 towards the material 32, causing the balls 34 to come into contact with the material 30. The user then moves the texture tool 20 back and forth in the desired locations on the material 32, causing the balls 34 and the texture plate 42 to create an impression, or imprint, on the material 32. This is accomplished as the plurality of balls 34 press against, and partially into, individual texture plate depressions 44, which in turn causes the material 32 to be embossed or imprinted.

Figure 3:
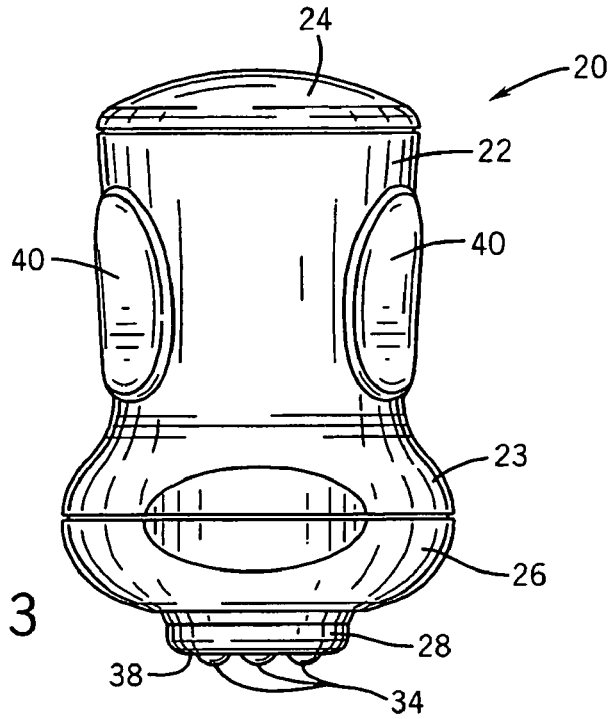
FIG. 3 is a left side view of the texture tool of FIG. 1.
Figure 4:
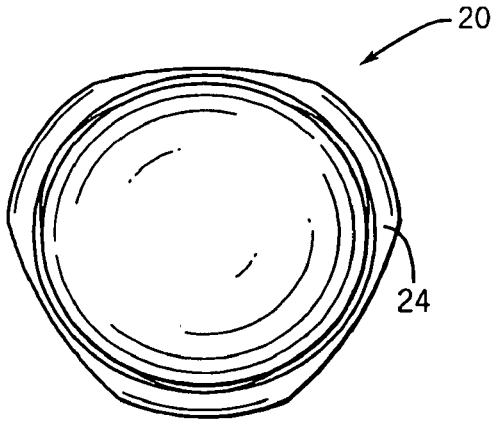
FIG. 4 is a top plan view of the texture tool of FIG. 1.
Figure 5:
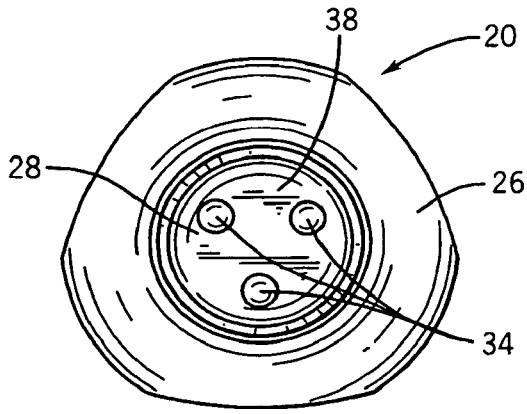
FIG. 5 is a bottom plan view of the texture tool of FIG. 1.
Figure 6:
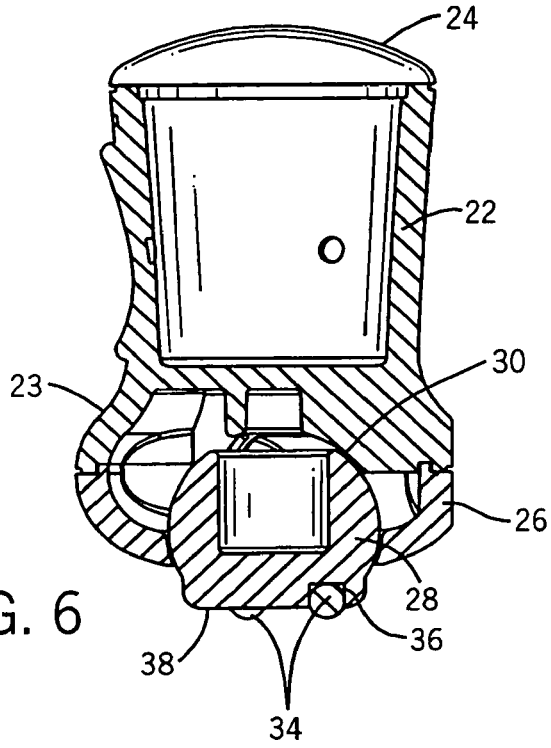
FIG. 6 is a sectional side view of the texture tool of FIG. 1.

As discussed earlier, a preferred embodiment of the invention, shown in FIG. 3, includes three balls 34 positioned within the ball holder 28. This is important because three points define a plane. Four or more points, however, can define multiple planes. Therefore, if there are four or more balls 34 on the flat surface 38, there would not be sufficient support for one or more of the balls 34. This would prevent the contact points of all of the individual balls 34 from falling partially into the texture plate depressions 44. For those ball contact points that do not fall into the texture plate depressions 44, there will be an inferior embossed texture. If there are less than three ball contact points, however, the user will have significantly less control over the entire texture tool 20, since two points do not define a plane at all. This can lead to the user inadvertently dragging a portion of the texture tool 20 across the material 32 that was not intended to be embossed or imprinted.

According to one highly preferred embodiment of the invention, the balls 34 are polished steel embossing balls having a diameter of about 0.125 inches. The body 22, the upper cap 24, the lower cap 26, the ball holder 28 and the grip portions 40 can all be made of various plastic materials.

While preferred embodiments of the invention have been shown and described, it will be clear to those skilled in the art, that potential modifications can be made to the embodiments described above. For example, each of the individual components of the texture tool 20 could be formed from a variety of acceptable materials. It will therefore be well understood by those in the art that modifications can be made to the above embodiments without departing from the invention in its broader aspects.

What is claimed is:

1. A method for creating a texture comprising:

providing a texture tool having a flat surface with a plurality of depressions, a body, and a plurality of balls operatively connected to the flat surface;

placing a sheet of a material on top of a texture plate having individual texture depressions;

positioning the texture tool with the flat surface towards the material; and moving the texture tool on the material, wherein, as the texture tool applies force to the material and the individual texture depressions, an impression is made on the material, and wherein the plurality of balls are mounted within the plurality of depressions.

2. The method of claim 1, wherein the plurality of balls comprises three balls that are securely mounted within the depressions.

3. The method of claim 1, wherein the texture tool further includes a plurality of grip portions positioned on the body for gripping by a user.

4. The method of claim 1, wherein the flat surface is configured to freely float and spin in order to remain in contact with the material when the orientation of the rest of the texture tool is altered.

5. A method for creating a texture comprising:

providing a hand-held texture tool having a flat surface, a plurality of balls that are mounted within a plurality of depressions on the flat surface, and a body, placing a sheet of a material on top of a texture plate having individual texture depressions;

positioning the texture tool with the flat surface towards the material; and moving the texture tool across the material, wherein, as the texture tool applies force to the material and the individual texture depressions, an impression is made on the material.

6. The method of claim 5, wherein the plurality of balls comprises three balls that are securely mounted within the depressions.

7. The method of claim 5, further comprising providing a plurality of grip portions positioned on the body for gripping by a user.

8. The method of claim 5, wherein the flat surface is configured to freely float and spin in order to remain in contact with the material when the orientation of the rest of the hand-held texture tool is altered.

* * * * *